US006997795B2

(12) United States Patent
Friel, Sr.

(10) Patent No.: US 6,997,795 B2
(45) Date of Patent: Feb. 14, 2006

(54) VERSATILE MANUAL SCISSOR SHARPENER

(75) Inventor: Daniel D. Friel, Sr., Greenville, DE (US)

(73) Assignee: Edgecraft Corporation, Avondale, PA (US)

( * ) Notice: Subject to any disclaimer, the term of this patent is extended or adjusted under 35 U.S.C. 154(b) by 0 days.

(21) Appl. No.: 10/914,872

(22) Filed: Aug. 10, 2004

(65) Prior Publication Data

US 2005/0037700 A1 Feb. 17, 2005

Related U.S. Application Data

(60) Provisional application No. 60/494,680, filed on Aug. 13, 2003.

(51) Int. Cl.
*B23F 21/03* (2006.01)

(52) U.S. Cl. ..... 451/555; 451/540; 451/552; 451/558

(58) Field of Classification Search ..... 451/558, 451/560, 525, 545, 371, 293, 241, 367, 549, 451/552, 555, 557, 57, 193, 224, 267, 282, 451/386, 556; 76/82.2, 84
See application file for complete search history.

(56) References Cited

U.S. PATENT DOCUMENTS 673,933 A * 5/1901 Wallace ..... 451/555
740,118 A * 9/1903 Goodfellow ..... 76/82.2
1,254,671 A * 1/1918 Gallagher ..... 451/555
2,652,667 A * 9/1953 Arnold ..... 451/555
4,627,194 A 12/1986 Friel
4,716,689 A 1/1988 Friel
4,807,399 A 2/1989 Friel
D303,209 S 9/1989 Friel
4,897,965 A 2/1990 Friel
D310,620 S 9/1990 Friel
5,005,319 A 4/1991 Friel
D328,410 S 8/1992 Friel
5,148,634 A 9/1992 Bigliano et al.
5,245,791 A 9/1993 Bigliano et al.
D342,003 S 12/1993 Friel et al.
D348,598 S 7/1994 Friel et al.
5,357,717 A 10/1994 Friel et al.
5,390,431 A 2/1995 Friel
D357,395 S 4/1995 Friel
5,404,679 A 4/1995 Friel et al.
5,449,315 A 9/1995 Friel et al.
5,458,534 A * 10/1995 Campione et al. ..... 451/555
D368,217 S 3/1996 Friel
5,582,535 A 12/1996 Friel
5,611,726 A 3/1997 Friel et al.
D388,304 S 12/1997 Friel
D408,254 S 4/1999 Friel et al.
D409,891 S 5/1999 Friel et al.
6,012,971 A 1/2000 Friel et al.
6,113,476 A 9/2000 Friel et al.
6,267,044 B1 7/2001 Friel
6,267,652 B1 7/2001 Friel et al.
6,726,551 B1 4/2004 Friel
6,863,600 B1 3/2005 Friel

* cited by examiner

*Primary Examiner*—George Nguyen

(57) ABSTRACT

A manual sharpener for sharpening either right or left-handed blades of scissors or shears comprises a support structure with an attached hand holding arrangement. A magnetic device holds at least one adhesive pad on the supporting structure. One or more precision angle blade guides are mountable on the structure.

21 Claims, 3 Drawing Sheets

VERSATILE MANUAL SCISSOR SHARPENER

CROSS-REFERENCE TO RELATED APPLICATION

This application is based on provisional application Ser. No. 60/494,680, filed Aug. 13, 2003.

FIELD OF INVENTION

This invention relates to an improved versatile manual scissor sharpener for sharpening a wide variety of either right or left handed scissors, shears, and similar cutting tools.

BACKGROUND OF THE INVENTION

Manual scissor sharpeners previously available have proven unsuccessful because of a lack of reliability, precision and versatility. They have lacked the means to provide either the correct sharpening angle, the angle for presharpening the edge or the range of precision angle guides necessary for different types of scissors. Consequently the user commonly damages his scissors and becomes extremely frustrated. There are many distinctly different types of scissors that complicates the task of sharpening them correctly. To sharpen scissors successfully requires identification of the type scissors and selection of the correct and precise angle guides for sharpening (honing) and presharpening the various types. Sharpening scissors improperly can render the scissors totally ineffective.

SUMMARY OF INVENTION

This invention describes an improved manual scissor sharpener that provides means to readily select and interchange easily precision angular guides set at appropriate sharpening angles for different types of scissors and the means to easily change the sharpening abrasive or the size of abrasive grit necessary for each sharpening step. In the subject sharpener, more efficient abrasives are used to speed up the sharpening process and means are provided to minimize the amount of metal that need be removed to create a superb edge quickly and with minimum manual effort. All of these elements are necessary for successful manual scissor sharpening. Sharpening scissors by hand is very labor intensive. The process of metal removal from a scissors edge by hand is consequently slow and time consuming, providing every opportunity to make damaging sharpening strokes at the wrong angle. Without appropriate equipment it is virtually impossible to hold manually the same angle stroke after stroke. Scissors and knives are distinctly different and must be sharpened at radically different angles. Knife edges are sharpened at highly acute total angles commonly 25 to 50 total degrees at the edge. Knives cut by the process of severing through the material at these relatively small angles.

Scissors are constructed with a pair of mating blades where the cutting facet on each blade is most commonly sharpened or honed at an angle of about 70° relative to the mating surface of the blades. The cutting process depends upon a shearing process between the two blades. As scissor blades are closed, the material to be cut is pinched between the blades and if the corner "edge" on the facet of each blade adjacent their mating surfaces is precisely honed, the meeting blades will cut the material as it is pinched by the blades.

If the corner "edges" are rounded even slightly the blades will not cut but only pinch the material and jam. Consequently for scissors to cut rather than pinch the material the corner "edges" along each facet must be precisely sharpened (honed)—that is the cutting corner of each blade facet must be formed accurately by a precise honing step using very fine abrasive grit.

THE DRAWINGS

DETAILED DESCRIPTION

Figure 1:
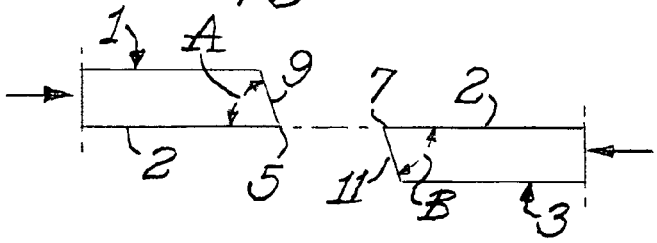
FIG. 1 is a side elevational view of a pair of opened scissor blades.

FIG. 1 illustrates a typical pair of opened scissor blades 1 and 3. The cutting facets 9 and 11 must be precisely honed at chosen angles A and B especially near the edge, in order to leave a sharp edge at corners 5 and 7. At the very edge itself the corners 5 and 7 must be geometrically perfect with an accuracy of about 5/10,000 of an inch or less if the blades are to cut well. The exact magnitude of angles A and B are less critical than the perfection with which the cutting "edge" is formed. The most popular scissor blades are commonly ground and honed at an angle on the order of 70° but the specialized so called knife edge scissor blades will have an angle as low as 50°. Clearly these two types of scissors are very different and need to be presharpened, sharpened and honed at very different yet precise angles.

The cutting "edge" must be honed precisely and with a relatively fine abrasive grit in order to obtain a truly sharp "edge" with geometric imperfections less than 5/10,000 inch. The inventor has shown that the creation of exceptionally sharp edges on scissors with a manual means depends upon using a highly accurate guide for the scissors and a very fine abrasive grit to hone and create the final "edge". But clearly an attempt to hone by hand the entire cutting edge facet with a fine grit is a tedious and time consuming effort. The sharpening process can, as explained herein, be shortened greatly by creating a corner "edge" on a small secondary facet honed immediately adjacent to the edge. In that manner a much more precise corner "edge" can be created and formed very quickly with less manual effort. None of the manual sharpeners known to this inventor have been designed to provide a means of sufficient accuracy to create readily such precise corner "edges" using a dual angle guide system—one angle guide for presharpening the entire facet and a second angel guide for honing a small corner facet using the appropriate abrasive grit means.

Prior art manual scissor sharpeners such as described in U.S. Pat. No. 371,689 have been difficult to use, tediously slow, and the performance of the scissors after sharpening has been far inferior to the edges that can be created by professional scissor sharpeners. The lack of versatility and precision of such manual sharpeners have been overcome by this inventor by employing sets of easily interchangeable precisely angled guides and sets of interchangeable diamond abrasives of appropriate grit size to permit and optimize the honing and presharpening (relieving) steps necessary to create edges of professional precision and hence sharpness.

The novel sharpening apparatus described here provides sets of precision sharpening angle guides, sets of abrasives including fine, abrasive grit pads necessary to hone precision honed corner edges and coarser abrasive grit pads needed to subsequently presharpen/relieve the entire blade face when the finer honing grit is no longer effective at the honing angle. The coarser grit is necessary to remove substantial metal in a reasonable time period from the cutting facet at a lesser angle relative to the mating face of the blade. The angle used for honing is optimally only a few degrees larger than the relief (presharpening) angle ground onto the blade face with the coarser grit. The novel apparatus described here incorporates a magnetic means to make it convenient to rapidly and easily interchange abrasive pads. Diamond abrasives are preferred to minimize the time needed to sharpen the blades. Importantly the physical design of the sharpener structure described here and the angle guides allows the guides to be manually attached and removed slidingly, enabling the angle guides to be used readily for sharpening either left or right handed scissors by either right or left handed individuals.

Figure 2:
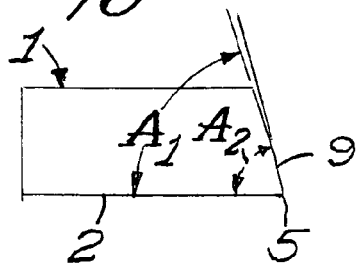
FIG. 2 is a side elevational view of a scissor blade facet.

FIG. 2 shows a scissor blade facet 9 ground with coarse grit at smaller angle A1 and honed at larger angle A2. It has become clear that sharpening scissors by a manual means is impractically laborious if one attempts to sharpen and resharpen by removing metal each time from the entire facet 9. It is remarkably easier to resharpen by creating a small facet at an angle A2 which is a few degrees larger than angle A1, FIG. 2. It is evident that if the entire facet is first presharpened at a smaller angle A1, very little metal needs to be removed in order to form the small facet at larger angle A2. Because less metal need be removed at angle A2 an exceedingly fine abrasive can be used to create a more perfect facet, angle and edge and it can be done quickly. It is also evident that the presharpening (relieving) of the entire facet can be done with a coarser more aggressive abrasive grit that reduces the time required to establish manually that larger facet area. It was found that with diamond abrasive of about 100 to 200 grit the entire facet of many scissors can be presharpened (relieved) in just a few minutes while it would take up to 30 minutes if the grit were 600 or 1200. While the presharpening/relieving can be done reasonably fast by using the coarser grit, that same grit would be too coarse for honing the final edge; that coarser grit would be incapable of creating a precisely formed corner edge. So by creating a smaller area facet at a slightly larger angle, for example 2° to 5° larger, it is possible to use an exceedingly fine grit to finely hone that facet and the final sharpening edge in less than one minute. This example illustrates the advantage of honing a small secondary facet at just a few degrees larger than the angle of the primary large blade facet and illustrates the advantages of designing a sharpener with ability to select rapidly and conveniently a separate presharpening (relief) angle and a slightly larger angle to hone the small facet and the corner edge. This selection of the appropriate angle for each of the presharpening and honing steps can be accomplished by using separate precision guides or by providing an adjustable angle guide that can be set conveniently either for presharpening the blade facet or for honing the final small facet at a somewhat larger angle.

Figure 3:
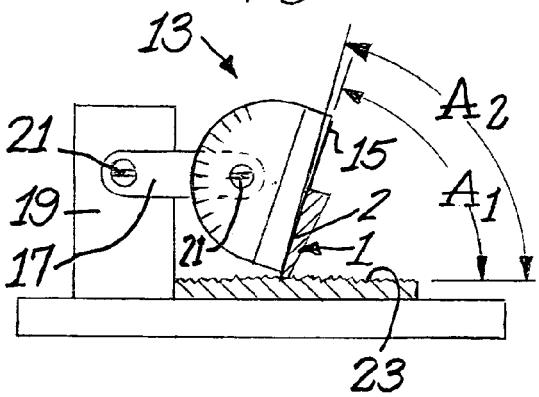
FIG. 3 is a side elevational view partly in section of a manual scissor sharpener in accordance with this invention.
Figure 4:
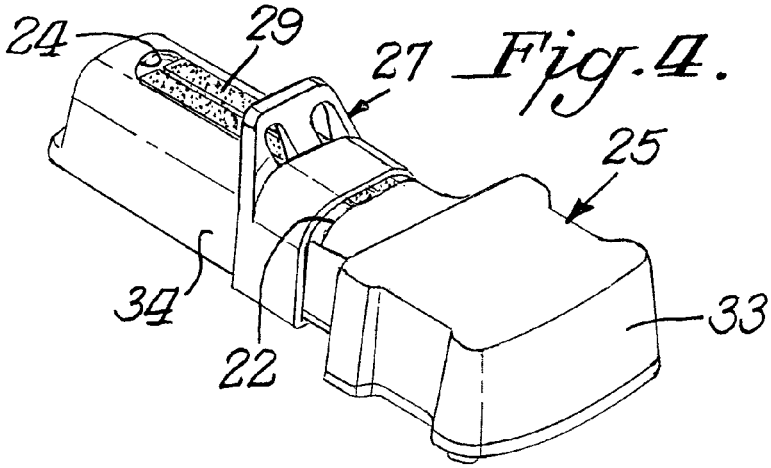
FIG. 4 is a perspective view of a manual scissor sharpener in accordance with this invention arranged for right handed operation.

FIG. 3 illustrates one mechanism 13 for setting precisely the presharpening angle and the honing angle of a scissor blade with a single adjustable guide. Angle guide 15 is supported thru linkage 17 by post 19. Adjustment screws 21 secure link 17 to the post 19 and the angle guide 15. The adjustment screws can be loosened and tightened while adjusting the angle A1 or A2. The angle guide 15 can be set at a A1 for presharpening and at A2 for honing the final facet. The scissor blade 1 shown in cross section can be moved back and forth across abrasive surface 23 to create the appropriate facets on the blade. The mating face 2 of the scissor blade must be held in intimate contact with face 15 of the angle guide It has proven convenient, reliable, and uniquely versatile to employ interchangeable angle control guides 27, such as shown in FIG. 4, that can be readily interchanged and can longitudinally slip slidingly onto such a sharpener structure and be held without the need for fasteners. It has proven highly effective to slip off a guide and to replace it with another at a different angle that is also held slidingly yet securely mounted to the sharpener structure in a manner that makes it easily applied, held, and removed.

Because the most common scissors as purchased have a blade facet of about 72°, it is convenient to set the honing angle guide at 75° to 77° and the presharpening angle guide at 72°. A very fine or ultrafine abrasive, preferably diamonds of about 600–1200 grit, is then used for honing at say 75° to create a small facet angled 3° greater than the original 72° facet. After many resharpenings when the honed facet becomes substantially larger in area and takes too long to sharpen with fine grit, the 75° honing guide is removed, the 600 or 1200 grit pad is removed and the 72° presharpening guide and a coarser diamond pad, about 100–300 grit is mounted on the sharpener. The entire blade facet is then presharpened with the coarser grit. If the scissor blade as purchased is angled at greater than 72° it is best to presharpen the blade first with the 72° guide and coarse grit in order to insure that the original angle is less than the honing angle. In that manner one is always assured that the honing angle will be larger and the fine grit abrasive can create easily and quickly a precise small facet at the edge, leaving the edge very sharp and durable.

Figure 5:
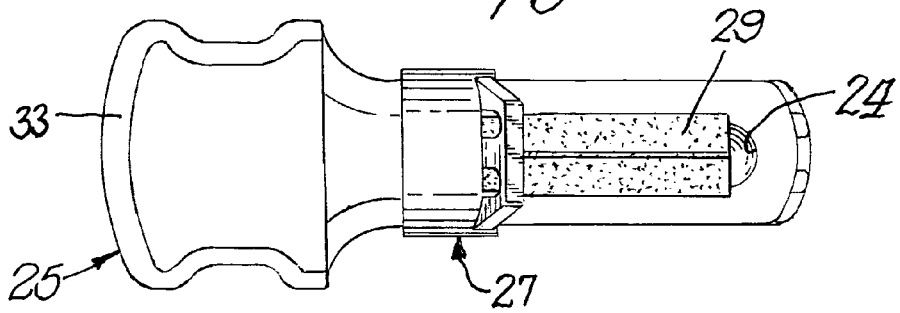
FIG. 5 is a top plan view of the sharpener shown in FIG. 4.
Figure 6A:
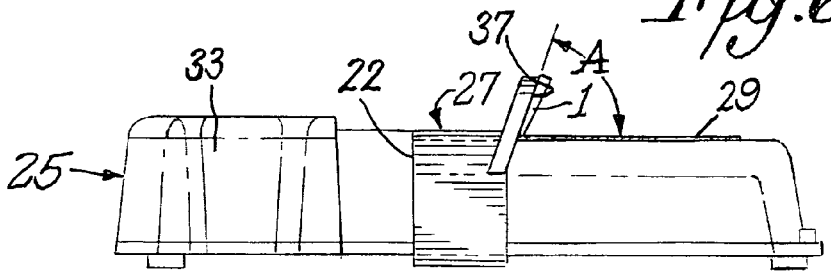
FIG. 6A is a side elevational view of the sharpener shown in FIG. 4.

A scissor sharpener 25 made in accordance with this invention is designed with elongated abrasive pads 29, as shown in FIGS. 4, 5 and 6 where the angle guides 27 are attached slidingly. The angle guides hold securely on the body 34 of the sharpener 25 but will slide easily allowing the user to presharpen or hone the blade facet anywhere along the length of the abrasive pad 29. Diamond abrasives on pad 29 are preferred not only because the diamond crystals are harder and sharpen and remove metal more efficiently, but because they do not "load-up" with sharpening debris (unlike other common abrasives) and because they do not wear significantly with use. The incorporation of diamond abrasives significantly enhances the effectiveness of this manual sharpener.

Figure 7:
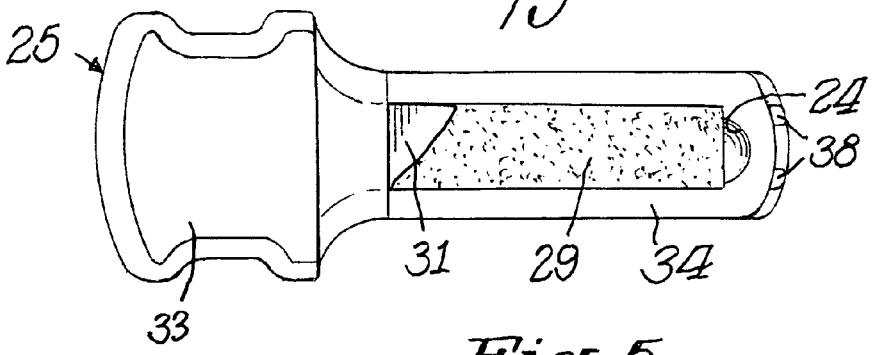
FIG. 7 is a bottom plan view of the sharpener shown in FIG. 4.

A magnetic pad-like structure or sheet 31, such as shown in the break away portion of FIG. 7 located below pad 29, proved to be a particularly convenient means to hold a ferromagnetic metal backed abrasive coated pad 29 securely on top of the sharpener 25, shown in FIGS. 5, 6A, 6B, 6C and 7. This magnetic sheet 31 attached or adhered to the body 34 of sharpener 25 makes it extremely easy to interchange pads 29 of the different abrasive grits as needed for the presharpening and honing steps, without fasteners. A recess 24 (FIGS. 5 and 7) in body 34 located near pad 29 permits the user to lift pad 29 from body 34 to remove the pad. Thus, FIGS. 5 and 7 illustrate two different pads, with the fine grit pad having a central longitudinal groove shown in FIG. 5 and the ungrooved coarse grit pad shown in FIG. 7.

The unique design of this sharpener allows it to be used easily by either left or right handed individuals and with either left or right handed scissors. For the sharpener 25 shown in FIG. 6A, a right handed person can hold the handle 33 with his left hand and hold the scissor blade with his right hand to sharpen. If the scissors are right handed the angle guide 27 can be positioned slidingly with the open angle A, as shown facing to the user's right. If the scissors are left handed or for a left handed person, the user can simply reverse the sharpener 180°, and the open guide angle A will be facing to his left as shown in FIG. 6C. Alternatively for a left handed scissors and a left handed user, the guide 27 can be completely removed, rotated 180° and mounted back on the sharpener with the guide plane angled toward the handle 33. The user would have to position the guide away from the handle a sufficient distance to expose the abrasive pad 29 below the guide plane and by using the fingers of the hand holding the sharpener, the user would maintain the guide at that position. Preferably, however, for a left handed user or left handed scissors the sharpener itself is simply reversed 180° from the position shown in FIG. 6A to the position shown in FIG. 6C. This reversibility of both the sharpener and the guides 27 uniquely permits either handed person to hold the sharpener comfortably and to sharpen either handed scissor.

Figure 6B:
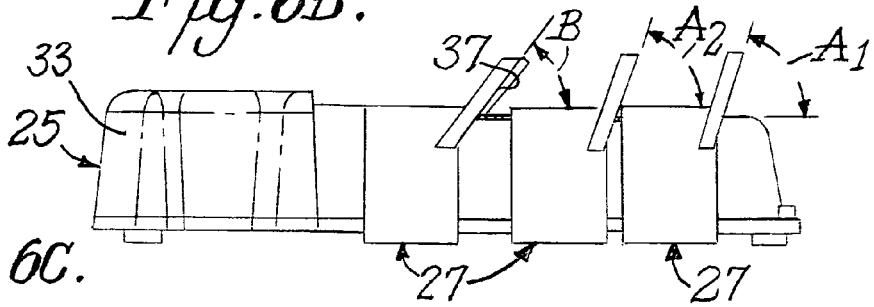
FIG. 6B is a view similar to FIG. 6A of a sharpener having multiple angle guides.
Figure 6C:
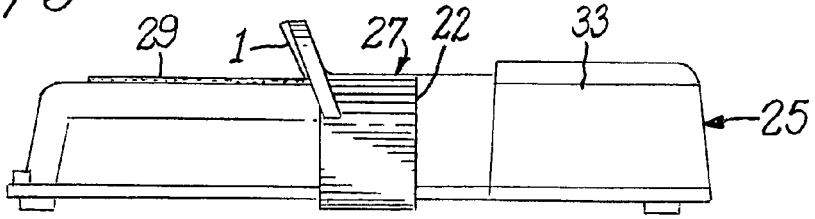
FIG. 6C is a view similar to FIGS. 6A and 6B of a sharpener arranged for left handed operation.

The versatility of this design allows the user to place simultaneously and conveniently (See FIGS. 5 and 6) use more than one appropriately angled precision angle guides 27 on the sharpener structure 25, as shown in FIG. 6B.

In the preferred practice of this invention the sharpener 25 would be placed adjacent to the edge of a table or other support surface. The user would hold the sharpener by grasping the handle 33. The guide 27 would be located so that its guide surface 37 extends away from handle 33. An advantageous feature of the invention is the ability to use essentially the entire length of abrasive pad 29 in sharpening the blade facet. For example, in one extreme position illustrated in FIGS. 6A and 6C the guide 27 is located against a shoulder 22 on body 34. In this position the guide surface 37 is over the abrasive pad 29 at its closest position toward handle 33. The user can place his fingers on the sleeve portion of guide 27 and slide guide 27 further away from handle 33 and then use the fingers to hold the guide 27 at the position when performing a different sharpening operation. This technique of the user holding the handle 33 and placing the fingers on the sleeve portion of guide 27 to position the guide 27 at different locations along the length of abrasive pad 29 thereby permits an increased area of pad 29 to be used during different sharpening operations so that use of the abrasive pad 29 will not be limited to one location and be prematurely worn out.

Figure 8:
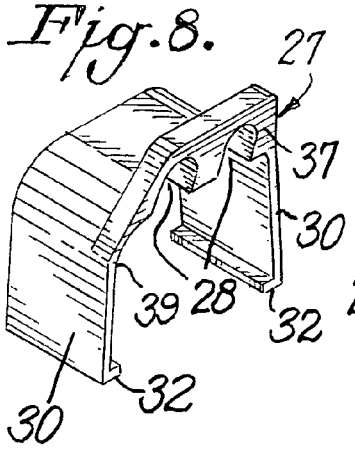
FIG. 8 is a perspective view of a guide which can be used with the sharpener shown in FIGS. 4–7.
Figure 9:
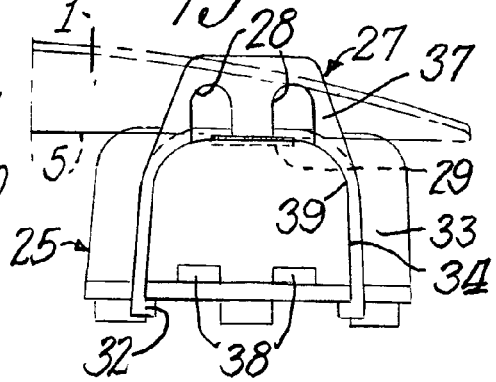
FIG. 9 is a front elevational view of the guide shown in FIG. 8.
Figure 10:
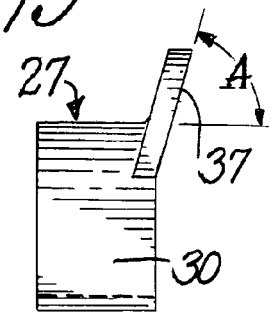
FIG. 10 is a side elevational view of the guide shown in FIGS. 9–10.

FIGS. 8, 9 and 10 show three views of a typical guide 27 which can be removably attached slidingly onto the sharpener structure 25. Such guides can be contoured in the sleeve portion 39 to hold firmly to the sharpener body and slide over the metal backed abrasive pad 29 which is attached securely magnetically to the magnet 31 of FIG. 7. The guides 27 are shown with holes (windows) 28 through guide surface 37 to its junction with sleeve 39 so that the scissor blade can be easily viewed when its face is aligned against the guiding surface 37, as in FIG. 6A. The abrasive pads 29 are sufficiently long that two or more such guides 27 can be mounted simultaneously for presharpening at angle A1 or alternately for honing irregular scissor blades (at angle A2, about 72°) and then honing knife-edge blades commonly at angle B, about 53°, as shown in FIG. 6B. The sharpener can be provided with angle guides with the appropriate angle for any scissor. Knife-edge scissors are generally thinner and the facets are sufficiently small that a single angle guide at the honing angle is usually sufficient. There is less need for a presharpening (relief) angle guide as the honing grit generally will be sufficiently fast on the smaller facet area.

As best shown in FIGS. 8 and 9, the side walls 30 of the main body or sleeve 39 of the generally inverted U-shaped guide 27 are shaped to generally conform to the upper and side walls of body 34 of sharpener 25. Side walls 30 may be resilient to snugly slidably fit against body 34. Each wall 30 has an inwardly directed flange 32 to fit under the bottom wall of body 34 to assure the proper mounting of each guide 27 on body 34.

Each guide 27 may be removed from the body 34 by simply sliding the guide 27 completely off body 34. Alternatively, where the side walls 30 of guide 27 are resilient, the side walls could be spread apart sufficiently to remove the guide 27. Where the removal is by sliding the guide 27 off body 34, the side walls 30 need not be resilient. Thus the guide 27 may longitudinally slide on body 34 and may also be removed and then again mounted on body 34 when changing from one guide to another.

As shown in FIGS. 8 and 10 the guide surface 37 is a surface on a plate-like upward extension of the main body or sleeve 39 of guide 27 and would be inclined at the desired angle.

Figure 11:
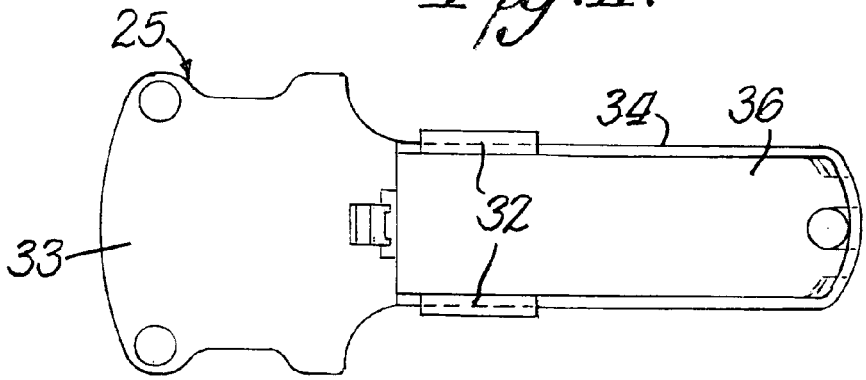
FIG. 11 is a bottom plan view of a sharpener in accordance with this invention showing a closed storage compartment.
Figure 12A:
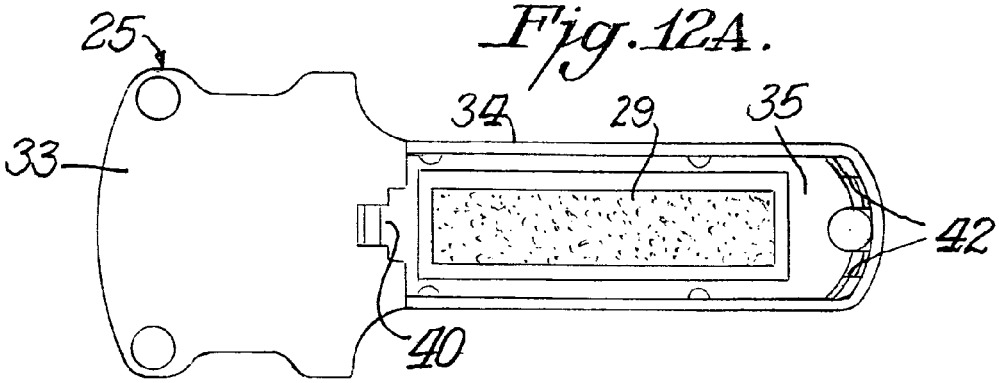
FIG. 12A is a bottom plan view of the sharpener shown in FIG. 11 with the storage compartment open.
Figure 12B:
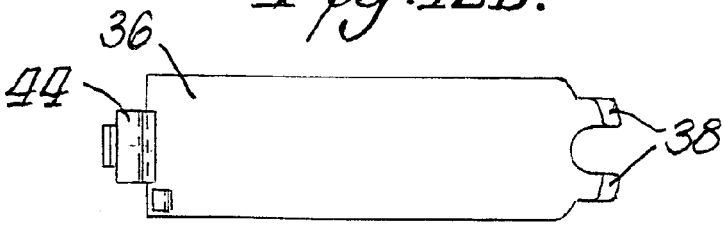
FIG. 12B is a top plan view showing the hatch cover used in the sharpener of FIGS. 11 and 12A.

This unique sharpener design as shown in FIGS. 11, 12A and 12B incorporates a convenient storage compartment 35 under the sharpening area large enough for storage of an assortment of abrasive pads 29. FIG 11 is a bottom view of the sharpener 25 with the compartment closed by a hatch cover 36. As shown in FIG. 12B, cover 36 includes a spring clamp closure 44 and tabs 38 similar to the type of removable locking structure conventionally used for battery compartments of various electrical control members, toys, etc. Any other type of detachable locking structure could also be used for hatch cover 36. FIG. 12A is a bottom view of sharpener 25 showing the exposed compartment 35 when cover 36 has been removed. As shown therein, sharpener 25 includes complementary structure 40 for engagement by clamp closure 44 and holes 42 for receiving tabs 38.

As shown in FIG. 11 guide flanges 32 terminate at or inwardly of cover 36 so as not to interfere with the removal of cover 36.

This disclosure describes a uniquely versatile manual scissor sharpener capable for the first time of creating professional quality cutting edges quickly and easily on a wide variety of scissors.

What is claimed is:

1. A manual sharpener for sharpening either right or left handed blades of scissors and shears comprising a supporting structure with an attached hand holding arrangement, at least one abrasive pad held on said structure, one or more precision angle blade guides that sharpen at different angles mountable on said structure, and where said precision angle blade guides attach and hold slidingly and detachably to said support structure to facilitate mounting of said guides onto said supporting structure and their removal therefrom and their interchangeability thereof.

2. A manual sharpener for sharpening blades of scissors and shears according to claim 1 where the abrasive on said at least one abrasive pad is diamonds.

3. A manual sharpener for sharpening blades of scissors and shears according to claim 1 where said pad is mounted on a body portion of said supporting structure, said guide comprising a generally inverted U-shaped sleeve conforming in size and shape to said body portion and being slidably mounted over said pad, and said sleeve having an upwardly extending plate which includes a guide surface over said pad.

4. A manual sharpener for sharpening blades of scissors and shears according to claim 3 where said plate is inclined away from said sleeve, and at least one hole formed through said plate to permit viewing therethrough.

5. A manual sharpener for sharpening blades of scissors and shears according to claim 4 where said main body includes inwardly extending flanges under the bottom of said body portion.

6. A manual sharpener for sharpening blades of scissors and shears according to claim 1 where said guide is slidably removable from said supporting structure.

7. A manual sharpener for sharpening blades of scissors and shears according to claim 1 where a compartment is in said body portion below said abrasive pad, and a cover selectively opening and closing access to said compartment.

8. A manual sharpener for sharpening blades of scissors and shears according to claim 7 where a further pad is stored in said compartment, and said pad and said further pad being of different abrasive properties.

9. A manual sharpener for sharpening blades of scissors and shears according to claim 8 where a recess is in said body portion at said pad to facilitate removal of said pad.

10. A manual sharpener for sharpening blades of scissors and shears according to claim 1 wherein a plurality of said guides are mounted on said structure, and said plurality of said guides having guide surfaces at angles which differ from each other.

11. A manual sharpener according to claim 1 where said abrasive pad is magnetically mounted to said structure.

12. A manual sharpener for sharpening right and left handed blades of scissors and shears comprising a support structure, a set of at least two interchangeable abrasive pads of different abrasive properties, each of said pads being selectively detachably mounted to said support structure, and one or more precision angle guides that attach and hold slidingly and detachably to said support structure to facilitate mounting of said guides onto said support structure and their removal therefrom and interchangeability thereof.

13. A manual sharpener for sharpening blades of scissors and shears according to claim 12 where a compartment is in said supporting structure, a cover selectively opening and closing said compartment, one of said pads being mounted on said support structure at and below said angle guide, and another of said pads being storable in said compartment.

14. A manual sharpener for sharpening right and left handed scissors conveniently by either left or right handed persons comprising a supporting structure with an attached hand holding structure, said supporting structure designed to hold slidingly and reversibly one or more precision angle guides onto said supporting structure to accommodate the opposite handed scissors by opposite handed person, and said one or more precision angle guides being selectively detachably mounted to said supporting structure.

15. A manual sharpener comprising a supporting structure with an attached hand holding arrangement, a set of abrasive pads each selectively mountable on said supporting structure, a set of precision angle blade guides each having a guide surface at a different angle from each other, and each of said blade guides being selectively mountable to and completely readily removable from said supporting structure for replacement by another of said blade guides whereby said blade guides may be selectively interchangeably mounted to said supporting structure to selectively dispose a different angle guide surface toward said abrasive pad.

16. A manual sharpener according to claim 15 wherein said set of abrasive pads have abrasive properties which differ from each other.

17. A manual sharpener according to claim 15 including a compartment in said supporting structure, said compartment having a top wall, an elongated recess in said top wall, one of said abrasive pads being mounted in said elongated recess, and the remaining of said abrasive pads being storable in said compartment.

18. A manual sharpener according to claim 17 including a magnetic sheet mounted in said elongated recess between said abrasive pad and said top wall, and said abrasive pad being magnetically mounted to said magnetic sheet.

19. A manual sharpener according to claim 18 including a further recess in said top wall communicating with said elongated recess to provide an area for lifting said abrasive pad out of said elongated recess.

20. A manual sharpener according to claim 15 where each of said precision angle blade guides includes mounting structure for reversibly mounting each of said blade guides to said supporting structure whereby said guide surface of each of said blade guides may be selectively disposed toward and away from said hand holding arrangement.

21. A manual sharpener according to claim 15 where more than one of said blade guides may be simultaneously mounted on said supporting structure.

* * * * *